United States Patent [19]

Knight et al.

[11] Patent Number: 4,977,921

[45] Date of Patent: Dec. 18, 1990

[54] HIGH GAS FLOW RATE PRODUCTION

[75] Inventors: Larry F. Knight, Seabrook; Daniel K. Ogilvie, Missouri City; Ronny W. Worsham, Pasadena, all of Tex.

[73] Assignee: Union Carbide Corporation, Danbury, Conn.

[21] Appl. No.: 409,766

[22] Filed: Sep. 20, 1989

[51] Int. Cl.[5] ..... B08B 9/00

[52] U.S. Cl. ..... 137/266; 15/3.5; 51/411; 51/436; 137/267; 137/268; 137/899.4

[58] Field of Search ..... 15/3.5, 3.51; 51/411, 51/436; 137/266, 267, 268, 899.4, 255, 263

[56] References Cited

U.S. PATENT DOCUMENTS

| | | | |
|---|---|---|---|
| 412,717 | 10/1889 | Bartlett | 137/263 X |
| 1,683,112 | 9/1928 | Weber | 137/263 |
| 2,011,347 | 8/1935 | Ragonnet | 137/266 X |
| 4,048,757 | 9/1977 | Kubus | 15/3.5 X |
| 4,197,712 | 4/1980 | Zwick et al. | 62/53 |
| 4,297,147 | 10/1981 | Nunciato et al. | 134/7 |
| 4,798,474 | 1/1989 | Daily | 118/408 |

*Primary Examiner*—Robert G. Nilson
*Attorney, Agent, or Firm*—Alvin H. Fritschler

[57] ABSTRACT

High gas flow requirements of large size lines are conveniently provided by a series of high pressure tubes connected to header means adapted to control the storage and distribution of gas to the lines at desired flow rates for relatively short periods of time. Gas thus supplied can conveniently be used as a propelling gas stream for the in-situ cleaning of large size lines under high exit velocity conditions requiring the supply of gas at a high flow rate not conveniently supplied by conventional pumpers.

11 Claims, 1 Drawing Sheet

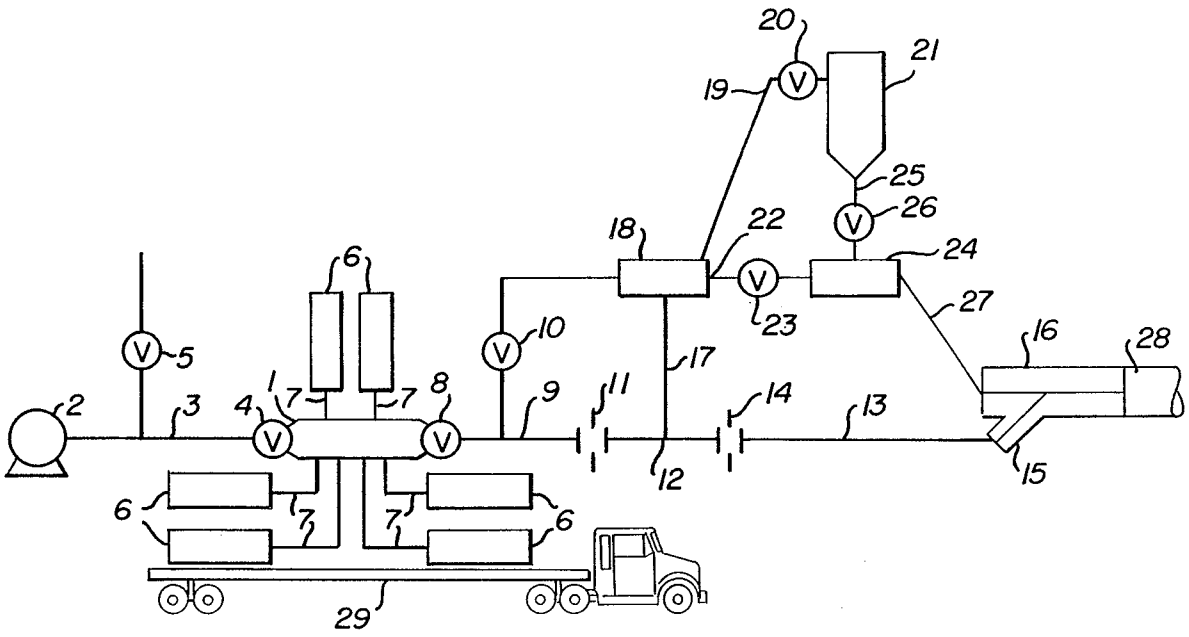
28
16
15
21
25
26
24
27
13
20
19
22
23
14
18
17
12
11
10
9
8
7
6
1
4
3
5
2
29

HIGH GAS FLOW RATE PRODUCTION

BACKGROUND OF THE INVENTION

1. Field of the Invention

The invention relates to the flow of gas through lines. More particularly, it relates to such flow through large lines having high flow rate requirements.

2. Description of the Prior Art

There are a variety of industrial operations that require the pumping of gases through relatively large size lines. As the diameter of the line increases, the flow rate requirements of the gas are correspondingly increased. For various applications, the providing of such high flow rate capacity can pose a practical problem from an operational viewpoint. In some instances flow rate limitations may preclude the carrying out of a desired operation with conditions requiring relatively high flow rates.

The in-situ cleaning of water or gas pipelines is a highly desirable industrial operation in which gas pumper flow rate limitations have tended to preclude application to large size lines. In such in-situ cleaning, an industrial service activity provided by Union Carbide Industrial Services Company (UCISCO) as the Sandjet® process, a high velocity, propelling gas stream (e.g. nitrogen) having cleaning particle entrained therein is injected into the line to be cleaned. The turbulent and swirling motion of the propelling gas stream in the line induces a high radial velocity to the cleaning particles, with sufficient energy to dislodge deposits from the inner walls of the line. Such dislodged deposits are removed from the line with the propelling gas stream and cleaning particles. The in-situ cleaning operation is continued, through a number of relatively short cleaning runs, until the unwanted deposit has been removed, as evidenced by the removal of a clean, essentially deposit-free gas stream from the outlet end of the line. A sufficient supply of propelling gas must be available for this in-situ cleaning process, which is commonly carried out at exit flow velocities of about 14,000 to 20,000 feet per minute, with 16,000 feet per minute being a typical exit flow velocity for such applications.

The in-situ cleaning process is normally limited to the cleaning of lines having a maximum diameter of 12 inches due to increasingly higher flow rate requirements for larger lines. Thus, at said 16,000 feet per minute exit velocity, a 6" line requires a gas flow rate of 3,142 scfm (standard cubic feet per minute), said flow rate increasing to 12,566 scfm for a 12" line, to 28,274 scfm for an 18" line, and to 50,265 scfm for a 24" line.

A conventional pumper for the vaporizing and pumping of liquid nitrogen, as employed in common commercial practice, typically has a maximum flow capacity of about 3,800 scfm. Thus, a 6" line can be cleaned using one such pumper, while four pumpers are required for a 12" line. Eight pumpers would be required for an 18" line, and a total of fourteen pumpers would be required for a 24" line. Under such circumstances, the use of such pumpers for the cleaning of lines larger than 12" becomes unduly expensive and presents practical logistical problems because of the large number of pumpers required. For certain cross country pipeline applications, such problems are obviated by the use of a technique referred to as ballasting, wherein a part of a line is pumped to the desired pressure and is then used to supply the required high flow rate needed in the in-situ cleaning of another portion of the line. For plant operations, ballasting has not been found feasible because no suitable line is typically available for ballasting. In order to achieve the required high flow rates of large size lines using pumpers only, a fleet of pumpers would have to be available for a particular job, and all of the pumpers would have to be connected to a common manifold, be supplied with liquid nitrogen and be brought on line simultaneously for each run of the in-situ cleaning process. Such an operation becomes increasingly more difficult and expensive with each additional pumper.

For some in-situ cleaning applications, it may be feasible to use air in place of nitrogen as the propelling gas. With respect to supplying high flow rates, however, it was determined that a 1,000 hp compressor will supply about 1,500 scfm of air. As with the pumpers referred to above, a large number of air compressors would be required for high flow operations, and the cost and space requirements associated with the use of air compressors would be prohibitive.

While in-situ cleaning of high flow rate lines has been precluded for the reasons indicated above, there is nevertheless a desire in the art for the use of the in-situ cleaning process for the cleaning of larger diameter lines. The inherent advantages of the in-situ process are such, compared with the alternatives of cutting open sections of the line, cleaning by mechanical means, and re-assembling the line, that it would readily be used for large size lines if a convenient means for providing the high flow rate requirements could be found.

It is an object of the invention, therefore, to provide a process and apparatus for the supply of gas at high flow rates.

It is another object of the invention to provide a process and apparatus for the supply of gas for in-situ cleaning and other operations requiring high flow rates for relatively short periods of time.

With these and other objects in mind, the invention is hereinafter described in detail, the novel features of which are particularly pointed out in the appended claims.

SUMMARY OF THE INVENTION

Gas for passage to a large diameter, high flow rate line is pumped to tube trailers, from which it is discharged through a common high flow header to said large diameter line. A desirably high flow rate is thereby obtainable for a desirable but relatively short period of time.

BRIEF DESCRIPTION OF THE DRAWING

The invention is hereinafter described in detail with reference to the accompanying single FIGURE drawing that is a schematic representation of the apparatus of the invention as employed in an in-situ process for the cleaning of a large diameter line.

DETAILED DESCRIPTION OF THE INVENTION

The objects of the invention are accomplished by the modifying of conventional tube trailers to serve as a source of ballast to supply a high flow rate of gas for a relatively short period of time. In the practice of the invention, nitrogen can be supplied conveniently at a job site for use as the propelling gas in the in-situ cleaning of large diameter lines requiring high flow rates for the relatively short duration of each run of the in-situ cleaning operation. Other applications requiring high flow rates of gas for short periods of time can likewise be carried out conveniently and efficiently using the process and apparatus of the invention.

Tube trailers are well known and are typically used to supply a gas, such as hydrogen, at relatively low flow rates, over extended periods of time, for various applications. Tube trailers are typically designed to supply gas at withdrawal flow rates of up to about 1,000 scfm. Such tube trailers typically comprise from about 6 to 10 or more tubes mounted on a movable trailer, a common header and cylinder valves to control the loading of gas into the tubes and the desired discharge of gas therefrom through the header and into the processing line.

For purposes of the invention, the header, or common manifold for the passage of gas, is generally from about 2" to about 4" in diameter, with a 3" diameter header being generally convenient and preferred for the in-situ cleaning application referred to above. The header should be sufficiently long so that the individual tubes can be conveniently attached thereto. While the header length may vary in particular applications of the invention, it is generally convenient to provide about 4" of header length for each tube employed in a tube trailer unit.

The individual tubes attached to the header are typically about 24" in diameter and 35 feet long, constructed of carbon steel and capable of withstanding pressures of up to about 2,500 psi pressure. Such tubes, it should be noted, are generally of the size used in conventional, low flow rate tube trailers, although the size thereof can be varied depending upon the gas flow requirements of any given application. In conventional tube trailer practice, a cylinder valve is provided in each tube. For purposes of the invention, the cylinder valves are removed from each tube, optionally with the installment of full opening ball valves, and a line, referred to as a pig tail, is run from each tube into the large common header. The diameter of the pig tails are typically from about 5/16" to 1", most commonly about ¾", for the typical high flow rate, short duration gas flow operations to which the invention is directed.

As in conventional low flow rate tube trailer practice, the apparatus of the invention will typically comprise from about 6 to about 10 individual tubes. It will be appreciated, however, that any desired number of individual tubes can be provided depending on the flow requirements of a given high gas flow rate application.

With reference to the drawing, the header for the passage of gas is represented by the numeral 1. Pumper 2 is provided for the passage of gas through conduit 3 into header 1, which has valve 4 positioned at the gas inlet end thereof. A relief valve 5 is desirably positioned in said line 3. A number of individual trailer tubes 6 are connected to header 1 by means of corresponding individual pig tails 7. Trailer tubes 6 and header 1 are shown mounted on movable trailer 29 for ready delivery to a job site having high flow requirements. Valve 8 is positioned at the gas discharge end of header 1 and controls the flow of gas into line 9 for passage to an in-situ pipeline cleaning application in the illustrated embodiment of the invention. A relief valve 10 is desirably positioned in line 9. Orifice 11 is positioned in line 9 so as to assure a constant flow of gas in said line prior to the dividing of said gas flow at junction 12.

Line 13, having optional orifice 14 positioned therein to assure a constant flow of gas, extends from junction 12 to tangential gas inlet 15 of gas injection head 16. Line 17 passes from said junction 12 to gas manifold 18 from which line 19 containing pot pressure valve 20 passes to the upper part of cleaning particle supply pot 21. Line 22, desirably containing set valve 23 to assure a desired pressure, extends to mixing chamber 24. At the bottom of supply pot 21, line 25 containing control valve 26 passes downward to mixing chamber 24. Line 27 extends from said mixing chamber 24 to gas injector head 16 and is positioned for axial injection of gas and particles therein As illustrated, injection head 16 is connected to pipeline 28 to be cleaned in-situ using gas supplied by the high gas flow rate apparatus of the invention.

In the practice of the illustrated embodiment of the invention, the gas supply and cleaning particle supply apparatus shown are connected to injection head 16 attached to pipeline 28, supply pot 21 is filled with flint, grit or other desired cleaning particles, and gas is pumped to the system by means of pumper 2. For this high flow rate, relatively short term in-situ cleaning application, nitrogen is commonly pumped from a source of liquid nitrogen supply and vaporized. The gas is pumped through conduit 3 into header 1, inlet end valve 4 being open and discharge end valve 8 being closed. The gas passes from header 1 into individual trailer tubes 6. Upon the loading of trailer tubes 6 with gas at the desired pressure, valve 8 is opened to provide for the passage of gas for purposes of the desired in-situ cleaning application. Gas from trailer tubes 6 passes through header 1 into line 9, from which a portion of the gas passes to gas injection head 16 through line 13. The remaining gas is diverted through line 17 for use in the controlled entrainment of cleaning particles therein prior to passage to said injection head 16. A portion of the diverted gas passes to the upper part of supply pot 21 to create a positive pressure therein to facilitate the metering of gas particles into the gas from line 22 in mixing chamber 24 to provide a gas stream having a controlled amount of cleaning particles entrained therein for passage to said injection head 16. This latter stream is desirably injected into injection head 16 in an axial manner, with the gas stream into injection head 16 through tangential gas inlet 15 being used to create a swirling position and desired turbulence to enhance the frequency and angle of impact of the cleaning particles with the inner walls of pipeline 28 to be cleaned, particularly at the feed end of said pipeline where the cleaning action is particularly enhanced by such turbulent action.

An in-situ pipeline cleaning run, i.e. a run lasting until the exhaustion of the cleaning particles in the supply pot, typically last about five minutes. Thus, the nitrogen required for a single run in an 18" line would be about 140,000 scfm to provide a desired exit flow velocity of 16,000 feet per minute from the line. A single conventional tube trailer with 8 individual tubes of typical size holds about 120,000 scfm of nitrogen. Two such tube trailers would thus hold enough nitrogen for an in-situ cleaning run, but could not supply the required gas flow because of their design typically for a maximum gas withdrawal rate of 1,000 scfm. Upon modification for purposes of the invention, however, such tube trailers can be used as ballast to provide nitrogen gas for the 18" line at a flow rate of about 26,000 scfm to provide the desired exit gas flow rate of 16,000 feet per minute for a cleaning run of five minutes. Using a 3" diameter header having a 3" valve on the discharge end, the header provides 250 psi nitrogen at said 26,000 scfm. The eight individual trailer tubes of 24" diameter and 35-foot length connected to the header for each tube are loaded at 2460 psi pressure to provide the necessary flow of gas for the required time. The high flow rate stream from the header can be divided into two streams, with one portion passing through a 6" line with a 3" orifice to provide a feed gas stream to the tangential gas inlet to the injection feed connected to the 18" line to be cleaned by the in-situ cleaning technique. The remaining portion of gas from the header can be diverted through a 3" line with a 2¼" orifice to a 4" manifold from which gas is passed to the upper portion of a cleaning particle supply pot to maintain a positive pressure therein. The remaining gas can be passed to a mixing chamber as a propelling gas stream to be subsequently passed to the injection head for axial injection therein. Cleaning particles are discharged from the bottom of the supply pot into the propelling gas stream for entrainment therein at a desired particle density for passage to the injection head and the 18" line being cleaned in-situ. Upon completion of the run, the discharge valve for the header is closed, and nitrogen gas is pumped through the header into the individual tubes in preparation for another high flow rate run in which the in-situ cleaning operation is continued using additional cleaning particles added to the supply pot. Such runs are continued until the inner walls of the 18" line being cleaned are sufficiently clean for an intended purpose.

Those skilled in the art will appreciate that various changes can be made in the details of the invention without departing from the scope of the invention as recited in the appended claims. Thus, the size of the header, the flow capacity of the header, the connecting gas flow lines, valves, orifices and the like can be adjusted depending upon the requirements of a given application. Similarly, the number of individual trailer tubes provided, and the diameter and length of the tubes can be varied depending on the gas flow requirements of a given high flow rate, large diameter pipe application.

It will also be understood that the in-situ cleaning operation referred to above is simply illustrative of the practical application of the invention in instances where a high flow rate is desirable in large diameter pipes for relatively short periods of time. Various pipeline inerting or purging applications, coke oven applications and other operations can be conveniently carried out using the high flow rate capabilities conveniently provided in the practice of the invention.

As indicated above, the desirable in-situ cleaning of pipelines could not be carried out on large diameter lines because, as a practical matter, the high flow rates of such jobs could not be accommodated, on a practical commercial basis, until high flow rates were provided in the practice of the invention.

In this and other operations, the invention provides a highly desirable advance in the art. By enabling high gas flow rates to be conveniently obtained in large size lines for a relatively short, but commercially practical period of time, the invention facilitates the carrying out of desired gas flow operations otherwise not feasible, from a technical and economic viewpoint, because of the high flow rate requirements of such operations in large size lines.

What is claimed:

1. An apparatus for the providing of gas to a large size line having high gas flow rate requirements, comprising:

(a) header means for the distribution of gas to be passed to a large size line at high flow rates therein;

(b) control valve means at the discharge end of said header means, said discharge end control means being adapted to provide for the discharge of gas at a rate sufficient to provide the desired high flow rate in said downstream large size line;

(c) pumping means suitable for the supply of gas to said header means at a desired elevated pressure suitable for the providing of said gas to said large size line at high flow rates;

(d) a series of high pressure individual tubes adapted for the storage of gas at elevated pressure for use in providing said high flow rate of gas in said large size line, said series of individual tubes and said header means and control valve means being mounted on a movable trailer for ready delivery to a job site having said high gas flow rate requirements;

(e) gas connecting lines extending from each of said individual gas storage tubes to said header means, said lines providing for the flow of gas from the header to said tubes upon application of said pumping means and the control valve means at the discharge end thereof being closed, and for the flow of gas from the tubes to the header for passage of the high flow rate line when said control valve means at the discharge end thereof is open, whereby gas is conveniently pumped through said header means to the individual tubes at an elevated pressure for subsequent discharge through said header means to the large size line having high gas flow requirements at a job site.

2. The apparatus of claim 1 in which said header means and said individual gas storage tubes are adapted to provide gas to the large size downstream line at a flow rate of at least 12,000 scfm.

3. The apparatus of claim 2 in which said header means and said individual gas storage tubes are adapted to provide said gas at a flow rate of at least 20,000 scfm.

4. The apparatus of claim 3 in which said header means and said individual gas storage tubes are adapted to provide said gas at a flow rate of at least about 30,000 scfm.

5. The apparatus of claim 1 in which said individual gas storage tubes comprise from about 6 to about 10 tubes.

6. The apparatus of claim 5 in which said gas connecting lines between said individual tubes and said header means comprise lines without any control valves positioned therein.

7. The apparatus of claim 1 and including a connecting line extending from the downstream end of said header means to the large size line to which gas is being passed.

8. The apparatus of claim 7 in which said connecting line extends to a pipeline to be cleaned in-situ, the gas passing therethrough providing the propelling gas stream for the passage of cleaning particles through said pipeline.

9. The apparatus of claim 8 and including a supply pot for cleaning particles to be used for said in-situ cleaning of the pipeline and including a by-pass line to direct a portion of the main body of the propelling gas stream for passage beneath said supply pot for the metering of cleaning particles therein, said by-pass line extending to said pipeline to be cleaned for the passage of said gas stream containing cleaning particles entrained therein to said pipeline.

10. The apparatus of claim 9 and including an injection head attached to said large size pipeline to be cleaned, said injection head being adapted to facilitate the passage of the main body of propelling gas and the portion thereof containing cleaning particles entrained therein to said large size line.

11. The apparatus of claim 10 in which said large size pipeline to be cleaned is 18" in diameter, said apparatus being adapted to provide gas thereto at a flow rate in excess of about 20,000 scfm in said 18" line, thereby providing an exit gas velocity of about 16,000 feet per minute from said line.

* * * * *